United States Patent [19]

Katsura et al.

[11] 4,250,808

[45] Feb. 17, 1981

[54] PRINTER

[75] Inventors: Akira Katsura, Amagasaki; Kiyoshi Nakata; Shoei Sakashi, both of Katano, all of Japan

[73] Assignee: Matsushita Electric Industrial Co., Ltd., Osaka, Japan

[21] Appl. No.: 14,768

[22] Filed: Feb. 23, 1979

[30] Foreign Application Priority Data

| | | | |
|---|---|---|---|
| Feb. 27, 1978 | [JP] | Japan | 53/22647 |
| Feb. 27, 1978 | [JP] | Japan | 53/22648 |
| Feb. 27, 1978 | [JP] | Japan | 53/22649 |

[51] Int. Cl.[3] ..... B41J 1/50; B41J 9/04

[52] U.S. Cl. ..... 101/93.15; 101/93.37; 400/328; 400/320; 400/372

[58] Field of Search ..... 101/93.37, 93.15, 93.16, 101/93.38, 93.39–93.46; 400/320, 328, 372, 120, 578, 120.1

[56] References Cited

U.S. PATENT DOCUMENTS

| | | | |
|---|---|---|---|
| 3,476,044 | 11/1969 | Wassermann | 101/93.15 |
| 3,885,661 | 5/1975 | Okabe | 400/328 |
| 4,123,182 | 10/1978 | Kondur | 101/93.15 |

*Primary Examiner*—Edgar S. Burr
*Assistant Examiner*—A. Heinz
*Attorney, Agent, or Firm*—Stevens, Davis, Miller & Mosher

[57] ABSTRACT

A small-sized and light weight printer which can suitably be incorporated in a desk-top calculator or the like. The printer has a simplified mechanisms for driving of a printing head, a paper feed and a printing control, and can operate stably with a reduced power consumption.

5 Claims, 8 Drawing Figures

PRINTER

BACKGROUND OF THE INVENTION

The present invention relates to a small-sized printer. Recently, there is an increasing demand for small-sized and light weight printers, as a result of the current tendency of adoption of LSI circuit parts. In fact, also in the field of electronic desk-top calculators, there have been proposed various portable and handy desk-top calculators provided with printers. There are also many requirements to be fulfilled such as minimization of size and weight, decrease in power consumption, reduction of production costs, making possible operation by a battery drive and so forth.

Most of printers conventionally used in combination with desk-top calculators are of mechanical impact type which make use of printing types. This type of printer, however, requires a large number of parts, which is quite contrary to the requirement of reduced size and weight. Thus, the printer of mechanical impact type cannot fully meet the requisite of reduced size and weight which are essential in combination with a desk-top calculator. Rather, for this kind of purpose, printers of thermal type or electro-sensitive type can advantageously be used, because of their simplified constructions.

Various printing systems of the thermal and electro-sensitive types have been proposed and actually used. One of these systems is so-called a serial system employing a printing head having a plurality of printing elements arranged in a row extending in the direction of paper feeding. In this system, the printing is effected by shifting the printing head widthwise of the paper. In another system called parallel system, the printing elements are arrange in a row in the widthwise direction of the paper, and the printing is made by feeding the paper at a small rate. Further, in still another system referred to as serial-parallel system, printing elements are arranged in a row in the widthwise of the paper, at a space equal to an integral multiple of the width of one character. The printing is made by reciprocatingly shifting the printing elements, while feeding the paper.

Unfortunately, however, there has been proposed almost no printer which would fully meet the aforementioned requirements such as minimization of size and weight, decrease in power consumption, reduction of production costs and lower driving voltage of the power source, all of which are essential when the printer is used in combination with a desk-top calculator.

SUMMARY OF THE INVENTION

It is therefore an object of the invention to provide a printer which can fully meet the above-mentioned requisites.

To this end there is provided a printer having a printing head, a drive unit including a motor, a head driving mechanism driven by the drive unit and arranged to have the printing head make a linear reciprocal movement between terminal ends of each line to be printed, and a paper feed mechanism, is characterized by the head driving mechanism comprising: a driving cam rotated about an axis by the drive unit; a pin attached to the drive cam; a slide block carrying the printing head through a head holder and arranged to make a linear reciprocal movement; a first, a second, a third and a fourth grooves formed in the slide block, the first through fourth grooves being successively connected so as to form a leaf shaped groove along which the pin slides upon the rotation of the driving cam, each of the first through fourth grooves consisting of an arcuate groove having a radius of curvature substantially equal to that of the locus drawn by the pin revolving upon the rotation of the driving cam; a pair of auxiliary pins attached to the slide block and arranged to periodically cooperate with the pin in its smooth transition from the first groove to the second groove and from the third groove to the fourth groove, thereby to have the slide block make a linear movement at a constant speed except at the terminal ends of the linear reciprocal movement.

The above and other objects as well as advantageous features of the invention will become more clear from the following description of the preferred embodiments taken in conjunction with the accompanying drawings.

DESCRIPTION OF THE PREFERRED EMBODIMENTS

Figure 1:
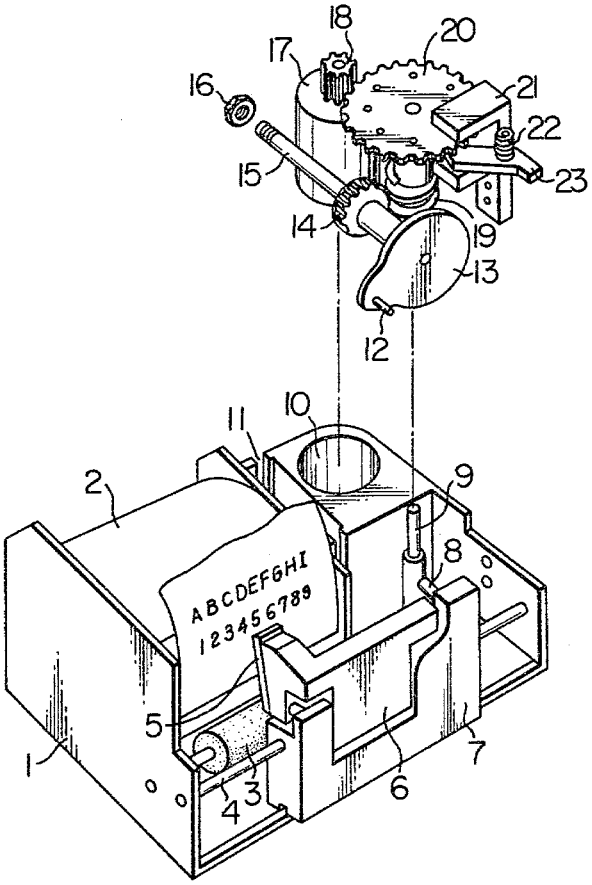
FIG. 1 is a perspective view of the whole part of a practical embodiment of the invention.

FIG. 1 shows a serial type printer, in which a printing head 5 is reciprocatingly moved in the widthwise direction of a paper 2 accommodated by a housing 1 to carry out the printing.

The printing head 5, which has been initially set in the illustrated position, is moved to the right-hand side end of its stroke, as a D.C. motor 17 is actuated. Then, the printing head 5 is pressed onto the paper 2, and the direction of stroke movement of the printing head 5 is changed to the left in order that the printing is started. When the printing head has been moved to the left-hand side end of the stroke, that is the printing of one line is completed, the printing head 5 moves to the right. The printing head 5 leaves the paper, and the paper is fed by one pitch of lines. Then, the motor 17 is stopped. For a continuous printing of a plurality of lines, the motor 17 continuously runs to repeat the above-described operation.

A thermal head of vertical 7-dot or an electrosensitive head may be used as the printing head 5 in this embodiment.

Hereinafter, the constructions of essential parts of this printer will be described in detail with reference to the attached drawings.

As the small-sized D.C. motor 17 is started, the output torque of the motor is transmitted to a detecting gear 20 through a pinion 18 fixed to the rotor shaft of the motor 17. The detecting gear 20 is formed unitarily with a worm 19 and is rotatably fitted onto a shaft 9. The rotation of the worm 19 is transmitted to a worm wheel 14 which is rotatable around a support shaft 15. The arrangement is such that, when the rotor of the motor 17 is rotated at 5000 r.p.m., the worm wheel 14 is rotated at 100 r.p.m. Namely, the reduction gear ratio is 50. As the worm wheel 14 is rotated, a driving cam 13 formed unitarily with the worm wheel 14 is rotated at the same speed. The motor 17 is fitted in a fitting hole 10, while the detecting gear 20 is inserted onto the shaft 9. Also, the support shaft 15 is received by a slot 11.

In the described embodiment, the driving cam 13 is adapted to cause three kinds of functions such as reciprocating movement of the printing head 5, pressing and releasing of the printing head 5, and the feeding of the paper.

The reciprocating movement of the printing head 5 is performed as follows. A pin 12 provided on the driving cam 13 is received in each of four grooves 32*a*, 32*b*, 32*c* and 32*d* formed in a slide block 7. Due to a specific form of engagement of the pin 12 and the grooves 32*a*, 32*b*, 32*c* or 32*d*, the slide block 7 carries out a reciprocating linear movement, as the driving cam 13 is rotated. The principle of this reciprocating linear movement will be described hereafter, with specific reference to FIGS. 2A to 2D.

Figure 2A:
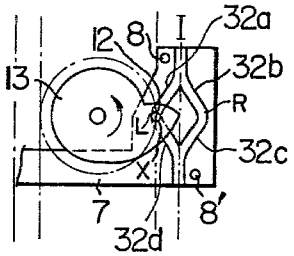
FIGS. 2A–2D illustrate the principles of operation of a head reciprocating mechanism.
Figure 2C:
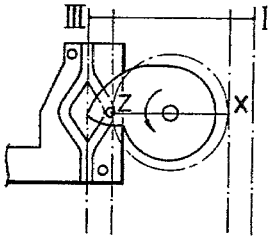
Figure 2D:
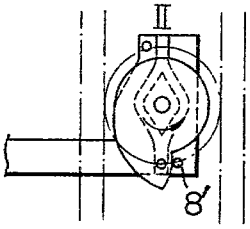

Assuming here that the pin 12 is in the position as shown in FIG. 2A, the slide block 7 is located at a position I. Then, as the pin 12 revolves in the direction of the arrow to a position shown in FIG. 2B, the pin 12 follows the groove 32*a*, forcibly moving the slide block 7 to a position II. When the slide block 7 has been moved to the position II, the driving cam 13 comes into contact at one portion with an auxiliary pin 8 mounted on the slide block 7. Then, as the driving cam 13 is further rotated, it presses the auxiliary pin 8 so that the pin 12 is forcibly introduced into the second groove 32*b*. A further rotation of the driving cam 13 forces the pin 12 to follow the second groove 32*b*, thereby to slidingly move the slide block 7 to a position III as shown in FIG. 2C. Then, as the driving cam 13 is rotated further, the slide block 7 starts to slide in the reverse direction with the pin following the groove 32*c*, and will come back to the position II as shown in FIG. 2D. At this time, the aforementioned portion of the driving cam 13 is brought into contact with another auxiliary pin 8' which is also mounted on the slide block 7. As a result, the pin 12 is forcibly switched to follow the groove 32*d*. Then, as the driving cam 13 is further rotated the pin 12 follows the groove 32*d* so as to forcibly return the slide block 7 to the starting position as shown in FIG. 2A.

According to the described arrangement, the slide block 7 completes one cycle of reciprocation between the positions I and III, while the pin 12 and the driving cam 13 make one revolution. It is possible to obtain a smooth constant-speed linear movement of the slide block 7, except at each stroke end, if each groove 32*a*, 32*b*, 32*c* or 32*d* is formed in arcuate shape having a radius substantially equal to that of revolution of the pin 12, and if the curvature of the aforementioned portion of the driving cam 13 for contracting the auxiliary pins 8, 8' is suitably selected. It is also to be noted that, while the stroke of movement of the pin along the horizontal axis is represented by a line x–z, the stroke of the slide block 7 is represented by a line I–III. In other words, the stroke of the slide block 7 is larger than that of the pin 12 by a distance between the portions L and R of the grooves. This increase of the stroke is quite advantageous, particularly when the printer is of the serial type which requires a large stroke of the printing head. For facilitating the understanding of the principle of reciprocating movement of the slide block 7, FIGS. 2A to 2D show the slide block and the pin 12 as viewed from the back side of the slide block 7, as if they were viewed from the front side.

Figure 4:
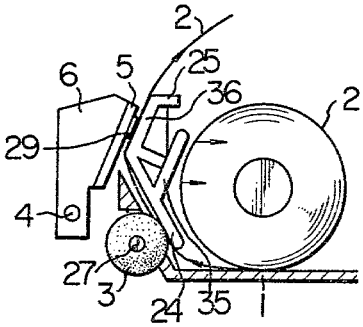
FIG. 4 is an illustration of a paper feeding mechanism.

Referring now to FIG. 4, a resilient tab 24 is formed unitarily with a platen 36 which is made of a resilient material. The upper portion of the platen 36 constitutes a paper guide 25. The resilient tab 24 is pressed onto a rubber roller 3 which is rotatably carried by a shaft 27. As the rubber roller 3 is rotated, the paper cramped between the roller 3 and the resilient tabs 24 is fed. A gear 28 which is fitted onto the shaft 27 for the rubber roller 3 engages a spiral gear 26 formed on one end surface of the driving cam 13. Since the radius of curvature of the spiral gear 26 is partially varied, the gear 28 is rotated intermittently, during one rotation of the driving cam 13. The resilient tabs 24 are moved away from the rubber roller 3 through a lever action by pulling a projection 35 integrally incorporated with the resilient tabs 24 in the direction of the arrow or, alternatively, by pressing the end portion in the direction opposite to the arrow, so as to release the paper 2 from clamping, thereby to allow a free insertion or withdrawal of the paper 2.

Figure 3:
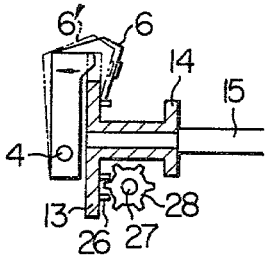
FIG. 3 illustrates how the printing head is pressed and released.
Figure 2B:
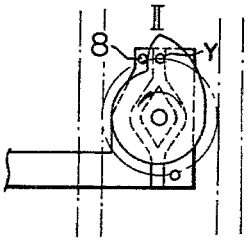

Meanwhile, the printing head 5 is pressed against the paper 2 by the resiliency of a spring which is not shown. Therefore, for feeding the paper by one pitch of lines, it is necessary to release the printing head 5 from the paper 2. To this end, the radius of the driving cam 13 is increased over a certain circumferential length, as shown by broken lines in FIG. 3. Therefore, upon the feed of the paper, a portion 6' of a printing head holder 6 is tilted in the direction of the arrow so as to move the printing head 5 away from the paper 2.

Figure 5:
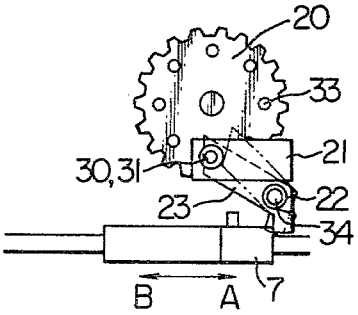
FIG. 5 is an illustration of a printing timing generating mechanism.

Referring now to FIG. 5, a plurality of detecting holes are defined in the detecting gear 20. These detecting holes are disposed at a constant circumferential pitch interval on a circle centered at the rotation center of the detecting gear 20. A light-emitting element 30 and a light-receiving element 31 are mounted on a holder 21, and are disposed to oppose to each other across the circle on which the detecting holes are disposed. The arrangement is such that the light emitted from the light-emitting element 30 is received by the light-receiving element 31, when one of the detecting hold 33 passes the optical path between the elements 30, 31, and the light-receiving element 31 produces a signal. This signal is utilized as a printing dot signal. Since the timing of this signal is mechanically synchronized with the moving position of the printing head, the printing is not affected by the change in speed of the motor 17, if any. A shutter 23 is swingably supported by a shaft 34. When the slide block 7 is moved in the direction of arrow A, the shutter 23 is pressed at its one end by the slide block 7 so as to bring its other end to a position for intercepting the optical path of the elements 30, 31. In this state, the light-receiving element 31 does not produce any output signal. Then, as the slide block 7 starts to move in the direction of arrow B, the shutter 23 is moved back to the initial position, by the force of a torsion spring 22 so as to clear the optical path thereby to allow the light-receiving element 31 to produce the printing dot signal. The position at which the printing is started is ruled by the timing of commencement of the delivery of the dot signal. Therefore, in order to align the position of start of the printing as accurately as possible, it is necessary to shorten the time required for the opening and closing action of the shutter, by making the length of the arm of the shutter 23 as long as possible.

Although, in the arrangement as shown in FIG. 5 the slide block 7 is used as the means for actuating the shutter 23, this arrangement, however, is not exclusive, that is; the shutter 23 may be actuated by the driving cam 13.

When it is desired to stop the printing head 5 at a desired position after the completion of printing of one line, the aforementioned printing dot signals are counted, and the motor 17 is forcibly stopped by an electric braking means (not shown) when a predetermined number of pulses have been counted. Alternatively, the shutter 23 is closed at a suitable timing, and the cease of printing dot signal is detected electrically by means of a timer such as a mono-stable multi-vibrator which in turn produces a signal to actuate electric braking means for stopping the motor 17.

In the printer of the embodiment heretofore described, either of thermal head and electro-sensitive head can be used as the printing head. In either case, the power consumption is considerably reduced and the required voltage of the power source is conveniently lowered to a level of 5 V D.C. Thus, the printer can operate with a power supply from batteries.

The printer of the invention having the described construction offers the following advantages.

(1) The reciprocating motion of the printing head 5, pressing and release of the printing head and the feed of the paper are conveniently effected by a single driving cam 13. As a result, the construction of the printer is highly simplified, and the problems of deviation of operation timing are mostly avoided. At the same time, the troublesome adjusting work for correcting the operation timing is completely eliminated.

(2) From a technical point of view, among various mechanisms incorporated in the serial type printer, the mechanism for effecting the reciprocating movement of the printing head is most difficult to design and require a large number of parts. This problem is fairly overcome by adopting the mechanism of the invention. Namely, according to the invention, the mechanism for causing the reciprocating motion of the printing head can be constituted only by a combination of the driving cam 13 and the slide block 7. It will be clear to those skilled in the art, that the pin 12 and the auxiliary pins 8, 8' can easily be formed unitarily with the driving cam 13 and the slide block 7, respectively. It is remarkable that the printing head 5 can be smoothly and linearly moved at a constant speed to a large stroking distance than the revolutionary radius of the pin 12 on the driving cam 13.

(3) In the conventional serial type printer, lead switches or mechanical contact type switches are used for controlling the start position of printing. According to the invention, these switches are substituted by the shutter 23 which opens and closes to control the printing dot signal. Thus, the number of parts is remarkably reduced, and various problems caused by switches, e.g. malfunction attributable to chattering of switches, can be avoided. Consequently, a low cost and highly reliable control of printing is obtained.

(4) The paper feeding mechanism of the invention does not incorporate a pinch roller, a spring and other parts which are essential in the conventional printer. The platen, the paper guide and the resilient tab which plays the role of the pinch roller and the spring are formed unitarily from a resilient material, thereby contributing to the simplification of the construction of the printer. The insertion and the withdrawal of the paper can easily be made by manually operating the projection 35 of the resilient tab 24.

(5) The number of parts required as a total is about 30. Also, the number of movable parts is reduced. Therefore, the printer of the invention can be driven by a motor which operates at a low voltage and which consumes little power. At the same time, the size and weight are considerably reduced, and the cost of production is economically lowered without substantial difficulty.

It will thus be seen that various industrial advantages are derived from the invention.

What we claim is:

1. A printer having a printing head, a drive unit including a motor, a head driving mechanism driven by said drive unit and arranged to have said printing head to make a linear reciprocal movement between terminal ends of each line to be printed, and a paper feed mechanism, said head driving mechanism comprising:

i. a driving cam rotated about an axis by said drive unit;

ii. a pin attached to said driving cam;

iii. a slide block carrying said printing head through a head holder and arranged to make a linear reciprocal movement;

iv. first, second, third and fourth grooves formed in said slide block, said first through fourth grooves being successively connected so as to form a leaf-shaped groove along which said pin slides upon the rotation of said driving cam, each of said first through fourth grooves consisting of an arcuate groove having a radius of curvature substantially equal to that of the locus drawn by said pin upon the rotation of said driving cam;

v. a pair of auxiliary pins attached to said slide block and arranged to periodically cooperate with said driving cam upon the rotation of the latter so as to assist said pin in its smooth transition from said first groove to said second groove and from said third groove to said fourth groove, thereby to have said slide block make a linear movement at a constant speed except at the terminal ends of the linear reciprocal movement.

2. A printer according to claim 1, further comprising a spiral gear unitarily formed on said driving cam, and a gear meshing with said spiral gear and arranged to drive a paper feed roller.

3. A printer according to claim 1, further comprising a projection integrally incorporated with said driving cam so as to form a part of the periphery of said driving cam, said projection being arranged to lift said head holder so as to move said printing head away from the paper.

4. A printer according to claim 1, further comprising means for generating a timing signal arranged to generate a signal representative of printing-dot timing, said generating means being coupled to said driving source, and a shutter blade in said generating means, said shutter blade being arranged to be swung by means of said slide block so as to selectively intercept the signal output from said generating means, whereby the position of start of the printing is set.

5. A printer according to claim 1, wherein said paper feeding mechanism includes a resilient tab formed unitarily with a resilient member which serves as a platen as well as a paper guide, said resilient tab being adapted to be pressed onto a paper feed roller through a medium of a paper interposed therebetween, whereby said paper is fed upon the rotation of said roller, and said resilient tab is moved away from said paper as a projection formed on said tab is manipulated.

* * * * *